US006168049B1

(12) United States Patent
Bolyard, Jr.

(10) Patent No.: US 6,168,049 B1
(45) Date of Patent: Jan. 2, 2001

(54) HOT MELT ADHESIVE APPLICATOR WITH CENTRALLY LOCATED FILTER

(75) Inventor: Edward W. Bolyard, Jr., Old Hickory, TN (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/433,491

(22) Filed: Nov. 3, 1999

(51) Int. Cl.[7] ..... B67D 5/58
(52) U.S. Cl. ..... 222/189.06; 222/146.5
(58) Field of Search ..... 222/146.5, 189.06, 222/189.11; 210/184, 186, 232, 435, 456

(56) References Cited

U.S. PATENT DOCUMENTS

| | | | | |
|---|---|---|---|---|
| 1,654,551 | | 1/1928 | Muhleisen . | |
| 2,465,404 | * | 3/1949 | Sonntag | 210/456 |
| 3,710,944 | * | 1/1973 | Budesheim | 210/232 |
| 4,042,504 | * | 8/1977 | Drori | 210/184 |
| 4,785,996 | | 11/1988 | Ziecker et al. . | |
| 4,969,602 | * | 11/1990 | Scholl | 239/298 |
| 5,145,689 | | 9/1992 | Allen et al. . | |
| 5,245,693 | | 9/1993 | Ford et al. . | |
| 5,381,510 | | 1/1995 | Ford et al. . | |
| 5,478,224 | * | 12/1995 | McGuffey | 222/189.06 |
| 5,860,602 | | 1/1999 | Tilton et al. . | |

* cited by examiner

*Primary Examiner*—Kevin Shaver
*Assistant Examiner*—Thach H Bui
(74) *Attorney, Agent, or Firm*—Mark W. Croll; Donald J. Breh; John P. O'Brien

(57) ABSTRACT

A hot melt adhesive applicator assembly comprises a hot melt adhesive applicator head which is provided with an upper or top surface portion, and a back or rear surface portion, upon which connectors are respectively provided so as to selectively alternatively connect an adhesive supply hose thereto. Provisions are likewise made for selectively alternatively mounting support brackets upon such upper or rear surface portions of the applicator head, and a filter assembly is adapted to be removably mounted upon an angled or inclined surface portion of the applicator head such that the filter assembly is disposed at a position intermediate the two alternative adhesive hose connectors. Still further, the entire applicator head may be angularly rotated through an angular movement of 90° and yet the filter assembly will be disposed upon its angled or inclined mount such that the filter member will nevertheless be oriented substantially vertically whereby adhesive will not undergo inadvertent leakage out of the filter assembly during filter change operations.

30 Claims, 4 Drawing Sheets

118
124
120
122
110
126
146
148
128
158
114
112
164
140
142
134
119
132
116
130
150
154
152

252
240
210
265
214
264
267
212
218
228
246
232
222
226
215
230

HOT MELT ADHESIVE APPLICATOR WITH CENTRALLY LOCATED FILTER

FIELD OF THE INVENTION

The present invention relates generally to hot melt adhesive applicators, and more particularly to a hot melt adhesive applicator assembly which enables the various components of the applicator assembly to be operatively assembled in various different modes or orientations so as to provide increased versatility for the hot melt adhesive applicator assembly with respect to the installation, integration, incorporation, and accommodation of the same into existing hot melt adhesive application or dispensing production equipment, installations, or production lines.

BACKGROUND OF THE INVENTION

In connection with hot melt adhesive applicator assemblies, such assemblies are conventionally provided in connection with various hot melt adhesive application or dispensing production equipment, installations, or production lines. However, due to the diversity of the disposition or arrangement of the various components comprising such various hot melt adhesive application or dispensing production equipment, installations, or production lines, it has conventionally proven difficult to enable such hot melt adhesive applicator assemblies to be readily installed, integrated, incorporated, or accommodated within such diverse equipment, installations, or production lines without the use of auxiliary adaptors.

It is also necessary to render such hot melt adhesive applicator assemblies relatively compact in order to satisfy the aforenoted spatial requirements of the various hot melt adhesive application or dispensing production equipment, installations, or production lines. Still further, a critical component of such hot melt adhesive applicator assemblies is the adhesive material filter which of course must be changed periodically so as to ensure the cleanliness or purity of the adhesive to be supplied to the hot melt adhesive applicator modules. The disposition of the filter component within the hot melt adhesive applicator assembly must therefore also be taken into consideration in order to render the replacement or exchange of the filter assemblies or modules quick and easy without any interference with or obstruction by either other existing components of the hot melt adhesive applicator assemblies, or existing components of the various hot melt adhesive application or dispensing production equipment, installations, or production lines.

A need therefore exists in the art for a new and improved hot melt adhesive applicator assembly which will permit the same to be used in connection with various hot melt adhesive application or dispensing production equipment, installations, or production lines, which is relatively compact, and which facilitates the ready and quick exchange or replacement of the filter assemblies or modules as a result of the elimination of any interference or obstruction of the filter assemblies or modules either with other components of the hot melt adhesive applicator assemblies, or existing components of the various hot melt adhesive application or dispensing production equipment, installations, or production lines.

OBJECTS OF THE INVENTION

Accordingly, it is an object of the present invention to provide a new and improved hot melt adhesive applicator assembly.

Another object of the present invention is to provide a new and improved hot melt adhesive applicator assembly which overcomes the various disadvantages of PRIOR ART hot melt adhesive applicator assemblies.

An additional object of the present invention is to provide a new and improved hot melt adhesive applicator assembly which has structural provisions incorporated therein which readily permits the same and its various components to be disposed in different orientations so as to permit the applicator assembly to be readily installed, integrated, incorporated, and accommodated within existing hot melt adhesive application or dispensing installations, equipment, or production lines.

A further object of the present invention is to provide a new and improved hot melt adhesive applicator assembly which is compact and readily facilitates the replacement or exchange of the filter assembly due to the disposition or location of the same within the assembly whereby any interference by or obstruction with either other components of the assembly or existing components of the various hot melt adhesive application or dispensing production equipment, installations, or production lines, is effectively eliminated.

SUMMARY OF THE INVENTION

The foregoing and other objectives are achieved in accordance with the principles and teachings of the present invention through the provision of a new and improved hot melt adhesive applicator assembly which comprises a hot melt adhesive applicator head which is provided with an upper or top surface portion and a back or rear surface portion upon which connectors are respectively provided so as to selectively connect an adhesive supply hose thereto. Provisions are likewise made for selectively mounting support brackets upon such upper or rear surface portions of the applicator head, and a filter assembly is adapted to be removably mounted upon an angled or inclined surface portion of the applicator head such that the filter assembly is disposed at a position intermediate the two alternative adhesive hose connectors. Still further, the entire applicator head may be angularly rotated through an angular movement of 90° and yet the filter assembly will be disposed upon its angled or inclined mount such that the filter member will nevertheless be oriented substantially vertically whereby adhesive will not undergo inadvertent leakage out of the filter assembly during filter change operations.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
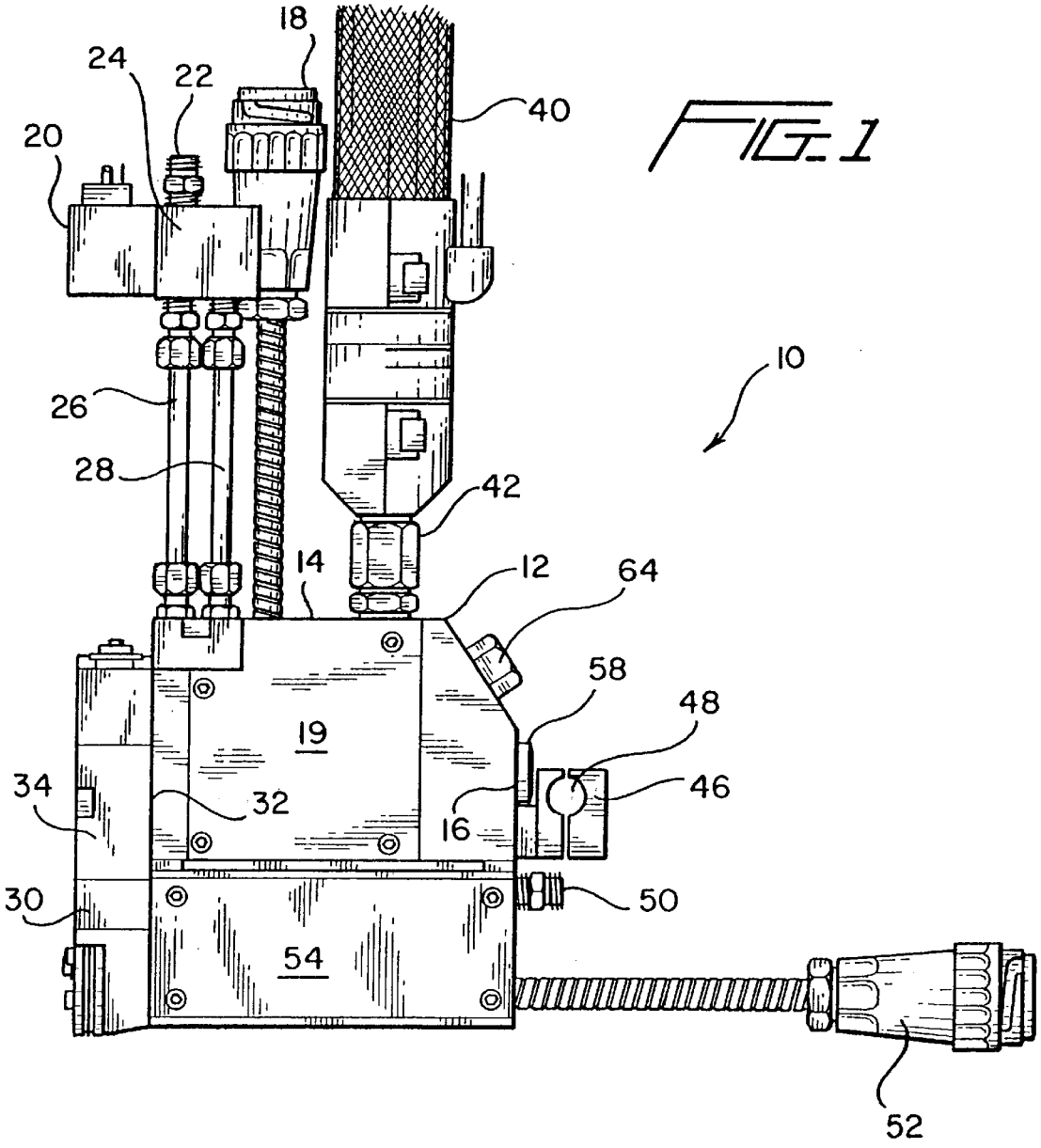
FIG. 1 is a front elevational view of a first embodiment of a new and improved hot melt adhesive applicator assembly constructed in accordance with the principles and teachings of the present invention wherein the hose connection for the supply of the adhesive material is disposed upon the upper or top surface portion of the applicator head, the mounting support bracket for the applicator head is disposed upon the rear or back surface portion of the applicator head, and the applicator head is oriented for use in connection with a vertical spray module.

Referring now to the drawings, and more particularly to FIG. 1 thereof, a first embodiment of a new and improved hot melt adhesive applicator assembly, constructed in accordance with the principles and teachings of the present invention, is disclosed and is generally indicated by the reference character 10. The applicator assembly 10 is seen to comprise an applicator head 12 which is provided with an upper or top surface portion 14 and a rear or back surface portion 16. In accordance with this first embodiment of the hot melt adhesive applicator assembly 10, the upper or top surface portion 14 of the applicator head 12 has fixedly mounted thereon an electrical power connector 18 which serves to provide electrical power to the heater mechanisms and temperature sensor of the applicator assembly 10 for heating and controlling the temperature level of the hot melt adhesive, the heater mechanisms and temperature sensor being disposed internally within the applicator head 12 as will be more fully disclosed hereinafter. An access cover 19 is provided upon the applicator head 12 so as to provide access to the electrical components of the electrical power connector 18 which are disposed internally within the applicator head 12.

In a similar manner, a control air module 20 is also mounted upon the upper or top surface portion 14 of the applicator head 12. The control air module 20 provides control air for effectively controlling the disposition of a piston, not shown, which in turn controls the disposition of a valve element, also not shown, of the applicator for controlling the dispensing of the hot melt adhesive from the applicator assembly 10. More particularly, the control air module 20 is seen to comprise a control air inlet connector 22 for fluidic connection to a supply of pressurized control air, not shown. The downstream end of the connector 22 is fluidically connected to a solenoid controlled valve 24 which is selectively controlled so as to alternatively supply the pressurized control air to either one of two control air supply conduits 26,28 which have their lower or downstream ends also fixedly mounted upon the upper or top surface portion 14 of the applicator head 12.

Figures 3, 4:
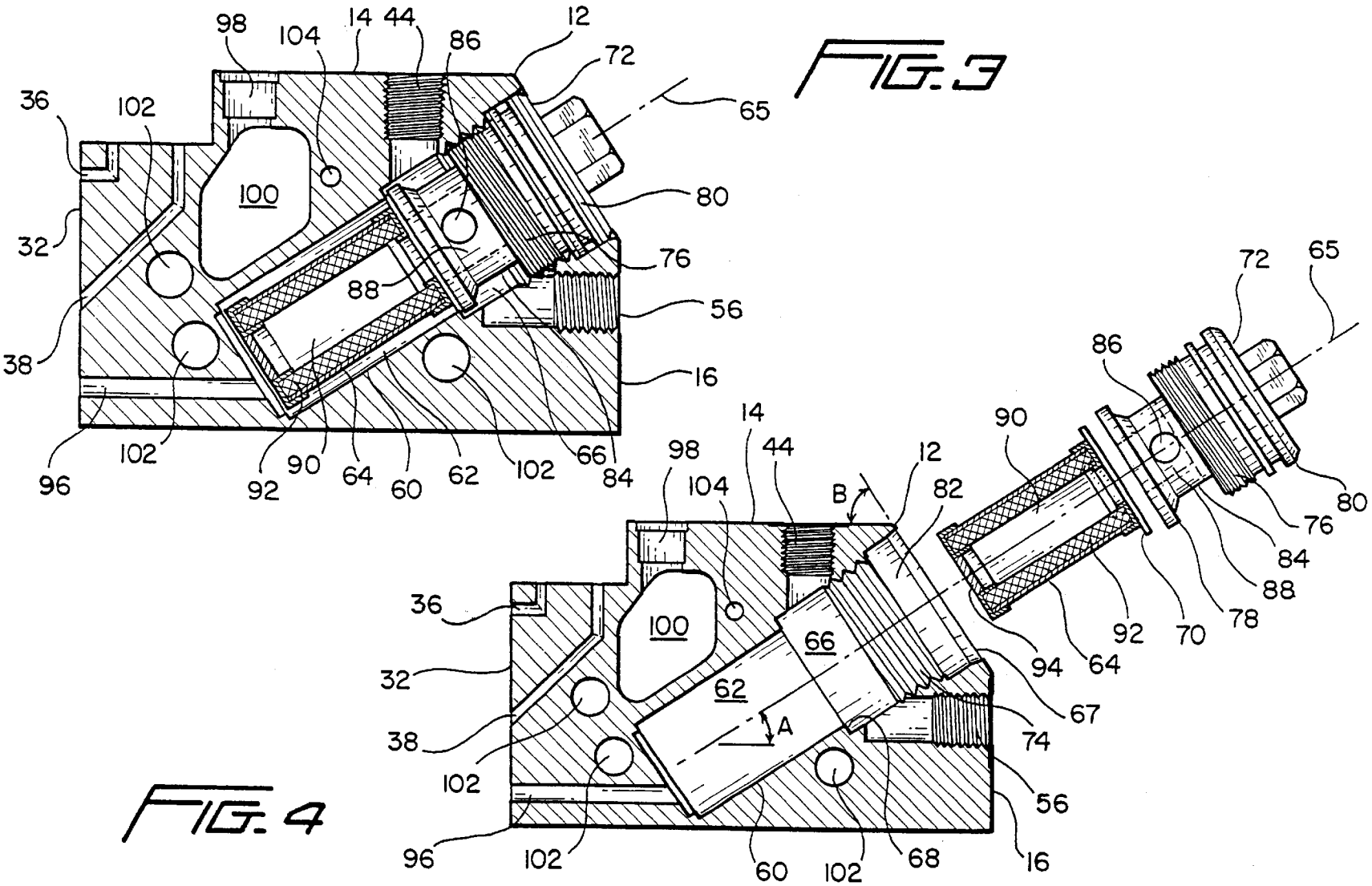
FIG. 3 is a cross-sectional view of the applicator head shown in FIGS. 1 and 2 showing the internal details of the applicator head enabling the use of the filter assembly in connection with the alternative dispositions of the adhesive supply hose connections.
FIG. 4 is an exploded cross-sectional view of the applicator head and filter assembly as illustrated in FIG. 3.

A vertical spray module 30, from which the hot melt adhesive is dispensed, is fixedly mounted upon the forward or front surface portion 32 of the applicator head 12, and the vertical spray module 30 comprises a cylinder housing portion 34 within which the piston, not shown, for controlling the hot melt dispensing valve, also not shown, is disposed. As best seen in FIGS. 3 and 4, control air conduits 36 and 38 are provided internally within the applicator head 12 so as to respectively fluidically connect the control air supply conduits 26,28 to control air supply ports, not shown, provided within the cylinder housing portion 34 of the vertical spray module 30 whereby pressurized control air is supplied to opposite sides of the piston, not shown, so as to appropriately control the disposition of the hot melt dispensing valve, not shown, between its opened and closed positions with respect to its valve seat as is well known in the art.

With continued reference being made to the first embodiment shown in FIG. 1, it is further seen that an adhesive supply hose 40 is also fixedly connected to the upper or top surface portion 14 of the applicator head 12 through means of a threaded connector 42 which is adapted to be threadedly engaged within a first, internally threaded adhesive supply inlet port, receptacle, or conduit 44 defined within the applicator head 12, as best seen in FIGS. 3 and 4, so as to supply adhesive material internally within the applicator head 12 as will become more apparent hereinafter. In order to either fixedly or movably mount the applicator assembly 10 for use during an adhesive dispensing application operation or cycle, depending upon the particular requirements of the adhesive dispensing equipment or production line facilities, a suitable mounting bracket is provided upon the applicator head 12. In accordance with one preferred means for mounting the applicator assembly 10, a rod mount bracket 46 is fixedly mounted upon the rear or back surface portion 16 of the applicator head 12. The bracket 46 has an aperture 48 defined therethrough for accommodating a support rod, not shown, upon which the rod mount bracket 46, and therefore the entire applicator assembly 10, can be slidably disposed and supported.

It is further seen that a spray air connector 50 is also provided upon the rear or back surface portion 16 of the applicator head 12 so as to provide incoming spray air which is used to fiberize the adhesive. In conjunction with the spray air connector 50, and the supply of spray air to the adhesive material, a spray air preheater power connector or mechanism 52 is likewise fixedly mounted upon the rear or back surface portion 16 of the applicator head 12 so as to preheat the incoming spray air supplied by means of the spray air connector 50. An access cover 54 is mounted upon the lower portion of the applicator head 12 so as to provide access to the electrical components of the spray air preheater power connector 52 which are disposed internally within the lower portion of the applicator head 12.

Figure 2:
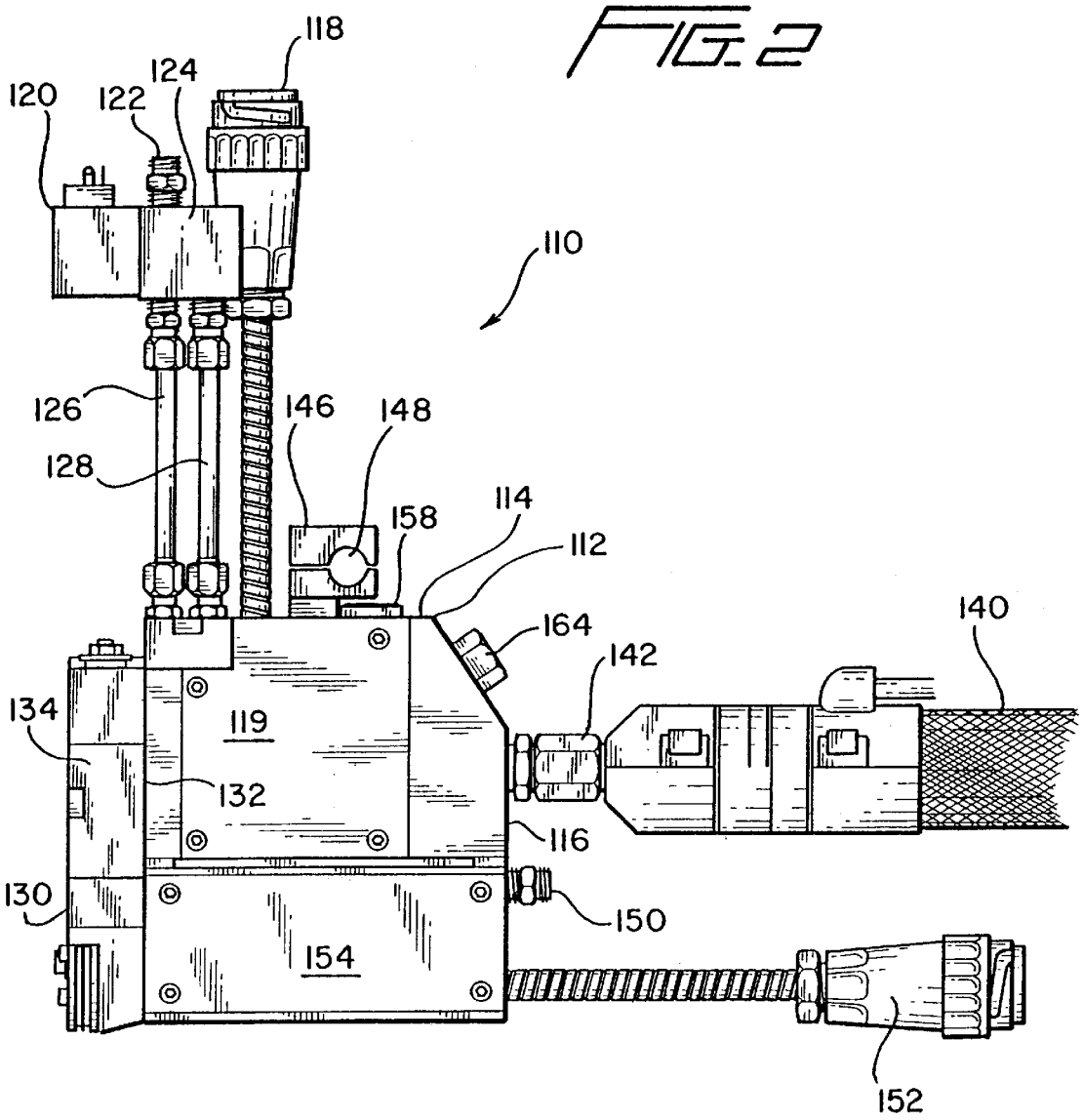
FIG. 2 is a front elevational view, similar to that of FIG. 1, showing, however, a second embodiment of the new and improved hot melt adhesive applicator assembly constructed in accordance with the principles and teachings of the present invention wherein the hose connection for the supply of the adhesive material is disposed upon the rear or back surface portion of the applicator head, the mounting support bracket for the applicator head is disposed upon the upper or top surface portion of the applicator head, and the applicator head is oriented for use in connection with a vertical spray module.

In accordance with the specific principles and teachings of the present invention, it is further seen that an additional or second internally threaded adhesive supply inlet port, conduit, or receptacle 56 is defined within the rear or back surface portion 16 of the applicator head 12 as best seen in FIGS. 3 and 4, and inlet port or receptacle 56 is adapted to have a second adhesive supply hose 140 threadedly connected thereto by means of a threaded connector 142 as shown in accordance with the second embodiment of the present invention as disclosed within FIG. 2 and indicated by reference characer 110. As can therefore be appreciated from a comparison of the first and second embodiments 10 and 110 of the present invention as disclosed within FIGS. 1 and 2, an adhesive supply hose 40,140 can be alternatively connected to either one of the adhesive supply ports 44 or 56 so as to permit the entire adhesive applicator assembly to be readily installed, accommodated, incorporated, or integrated within existing adhesive supply equipment or production line facilities. It is also to be noted that in connection with the first and second embodiments of FIGS. 1 and 2, like or corresponding parts of the systems have been designated by similar reference characters although the reference characters for the second embodiment of FIG. 2 are within the 100 series.

It is to be appreciated further that in accordance with the teachings and principles of the present invention that when the adhesive supply hose 40 is mounted upon the upper or top surface portion 14 of the applicator head 12, the mounting bracket 46 is mounted upon the rear or back surface portion 16 of the applicator head 12, and conversely or alternatively, when the adhesive supply hose 140 is mounted upon the rear or back surface portion 116 of the applicator head 112, the corresponding mounting bracket 146 is mounted upon the upper or top surface portion 114 of the applicator head 112. In a similar manner, when the adhesive supply hose 40 is mounted upon the upper or top surface portion 14 of the applicator head 12, a threaded plug 58 is threadedly engaged within the second internally threaded adhesive supply inlet port or receptacle 56 of the applicator head 12, whereas when the adhesive supply hose 140 is mounted upon the rear or back surface portion 116 of the applicator head 112, a threaded plug 158 is threadedly engaged within the first internally threaded adhesive supply inlet port or receptacle 44 of the applicator head 12 (112).

In order to in effect render the applicator assembly alternatively operative in either one of its modes, that is, either as assembly 10 wherein the adhesive supply hose 40 is connected to the upper or top surface portion 14 of the applicator head 12, or as assembly 110 wherein the adhesive supply hose 140 is connected to the rear or back surface portion 114 of the applicator head 112, the internal structure of the applicator head will now be further discussed in connection with renewed reference to FIGS. 3 and 4. It is noted that while reference is being made to the applicator head 12 as shown in FIGS. 3 and 4, such discussion holds equally true for the applicator head 112 of the embodiment of FIG. 2 in view of the fact that the applicator heads 12 and 112 are identical and the only difference between the embodiments of FIGS. 1 and 2 resides in the actual operative connections of the adhesive supply hoses 40,140 to the applicator heads 12,112 as well as the corresponding disposition of the mounting brackets 46,146 and the use of adhesive supply port or receptacle plugs 58,158.

Consequently, with reference again being made to FIGS. 3 and 4, it is seen that the first and second adhesive supply inlet ports 44 and 56 respectively defined within the upper or top surface portion 14 and the rear or back surface portion 16 of the applicator head 12 have axes which are disposed substantially perpendicular to each other, and interposed between the downstream or innermost end portions of the ports or conduits 44 and 56 there is provided a filter cavity 60. The filter cavity 60 has a longitudinal axis 62 which is disposed at an angle A of 34° with respect to the horizontal, and it is seen that the lower end portion of the filter cavity 60 comprises a filter housing section 62 which accommodates a filter member or assembly 64.

An intermediate section 66 of the filter cavity 60 has a larger diametrical extent than that of lower filter housing section 62 and is separated therefrom by means of a shoulder 68. As can be further appreciated, intermediate section 66 of the filter cavity 60 is fluidically interconnected to both of the adhesive supply inlet ports or conduits 44 and 56 such that when adhesive is supplied to either one of the adhesive supply inlet ports or conduits 44 or 56 through means of their respective adhesive supply hoses 40 or 140, the adhesive is able to be conducted into intermediate section 66. As can best be seen from FIG. 4, the filter member or assembly 64 has an upstream flange portion 70 which is adapted to be seated upon the shoulder portion 68 of the filter cavity 60 when the filter member or assembly 64 is inserted within the filter cavity 60.

In order to secure the filter member or assembly 64 within the filter cavity 60, a filter cap 72 is provided. An internal peripheral portion of the applicator head 12 which defines an upper section of the filter cavity 60 is threaded as at 74, and an axially central portion of the filter cap 72 is externally threaded as at 76 so as to threadedly engage the threaded portion 74 of the filter cavity 60. The innermost end portion of the filter cap 72 comprises an annular flanged portion 78 for engaging the flanged portion 70 of the filter assembly 64 when the filter cap 72 is threadedly secured within the filter cavity 60, and the outer end portion of the filter cap 72 comprises a seat member 80 for engaging a seat portion 82 defined within the outermost region of the filter cavity 60. An annularly recessed portion 84 is defined upon the filter cap 72 at an axial position between the threaded portion 76 and the end flanged portion 78, and a transversely disposed through-bore 86 extends diametrically through the annularly recessed portion 84. In addition, an axially extending bore 88 provides a fluidic connection from the through-bore 86 to the end face of the flanged portion 78.

The filter member or assembly 64 also comprises an axial passageway 90 defined within an annular filter element 92, while an end face 94 of the filter member or assembly 64 closes the innermost end portion of the filter member or assembly 64. In this manner, when adhesive is supplied to either one of the adhesive supply ports or conduits 44 or 56, the adhesive can pass into the intermediate section 66 of the filter cavity 60, proceed around the annularly recessed portion 84 of the filter cap 72, into the transversely disposed through-bore 86, through the axial passageways 88 and 90 of the filter cap 72 and the filter assembly 64, and pass outwardly through the filter element 92 and into the lower filter housing section 62 of the filter cavity 60. An adhesive outlet conduit 96 is defined within a lower portion of the applicator head 12 so as to fluidically connect the lower filter housing section 62 of the filter cavity 60 with the adhesive spray module 30 whereby adhesive material can be supplied to the module 30 for an adhesive application operation.

With continued reference being made to FIGS. 3 and 4, it is further seen that an inlet port 98 is defined within the upper or top surface portion 14 of the applicator head 12 such that electrical power cables from the electrical power connector 18 can be inserted into the applicator head 12, and a wiring cavity 100 is also provided within the applicator head 12 for accommodating the power cables, not shown. As noted hereinbefore, the power cables provide electrical power from the connector 18 to the plurality of applicator head heater elements 102,102,102 which are embedded in a predetermined distribution pattern throughout the applicator head 12 in order to substantially heat the same in a uniform manner so as to in turn heat the incoming adhesive material flowing along the path previously noted hereinbefore as extending between the inlet ports 44, 56 and outlet port or conduit 96. A temperature sensor or probe 104 is also disposed in an embedded manner within the applicator head 12 so as to sense the temperature of the applicator head 12 and thereby control the energization of the heater elements 102,102,102 in response to the sensed temperature.

While it has been noted that the arrangement of the various components of the hot melt adhesive applicator assemblies 10 and 110 can be arranged or disposed in various modes as disclosed within FIGS. 1 and 2 so as to permit accommodation of the applicator assemblies 10 and 110 within confined or constrained space limitations of conventional installations, equipment, production line facilities, and the like, further arrangements or varied dispositions of the applicator assemblies 10 and 110 can in effect be attained by changing or altering the actual disposition or orientation of the applicator head. This can be appreciated by reference being made to the third embodiment of the present invention as disclosed within FIG. 5 wherein all component parts of such embodiment, corresponding to the similar component parts of the second embodiment of FIG. 2 are denoted by similar reference characters except that the reference character are in the 200 series. In particular, it is noted that the applicator head 212 has in effect been rotated through an angular orientation of 90° such that, for example, the control air inlet port 222, control air supply conduits 226,228, electrical power connector 218, and adhesive dispensing or spray module 230 are now disposed horizontally, while adhesive supply hose 240 and the air preheater power connector 252 are now disposed vertically.

Figure 5:
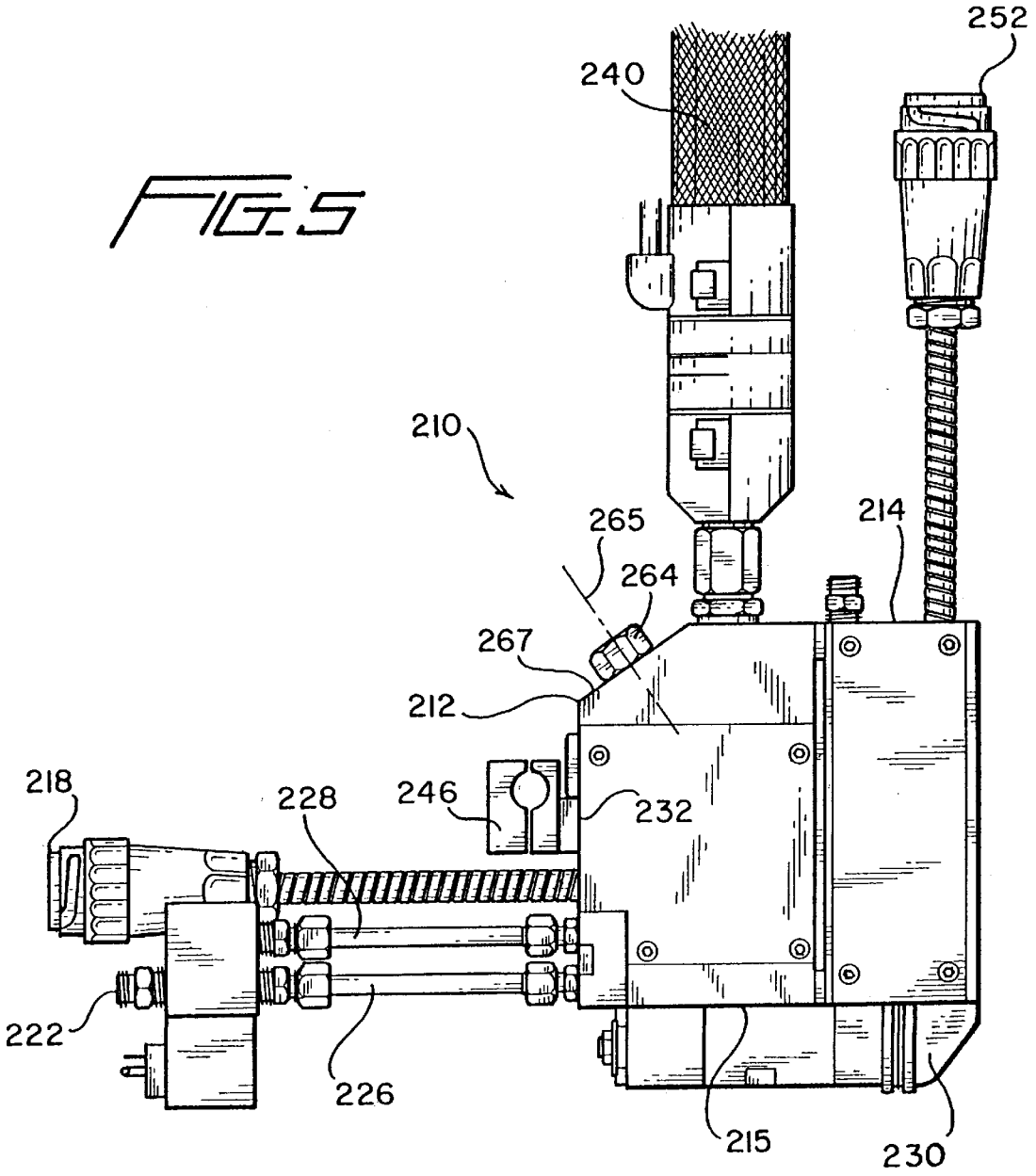
FIG. 5 is a front elevational view similar to that of FIGS. 1 and 2 showing, however, a third embodiment of the new and improved hot melt adhesive applicator assembly constructed in accordance with the principles and teachings of the present invention wherein the hose connection for the supply of the adhesive material is disposed upon the upper or top surface portion of the applicator head, the mounting support bracket for the applicator head is disposed upon the rear or back surface portion of the applicator head, and the applicator head has been effectively rotated 90° with respect to the disposition of the applicator head as shown in FIGS. 1 and 2 so as to be oriented for use in connection with a horizontal spray module.

An interesting and critically important feature of the hot melt adhesive applicator head structure, comprising any one of-applicator heads 12,112, or 212, it being remembered that the heads are actually the same identical head except for the orientation of the same as well as the actual connections thereto of the various components as has been noted hereinbefore, is that the filter assembly 64 is mounted within any one of the applicator heads 12,112,212 such that the longitudinal axis 65 extends perpendicular to an external surface 67 of the applicator head 12, for example, which is disposed at an angle B of 56° with respect to the horizontal as best seen in FIG. 4. Conversely, when the applicator head is angularly oriented or rotated 90° to its alternative disposition as shown in FIG. 5, the external inclined surface 267 is now disposed at an angle of 34° with respect to the horizontal, and the front surface portion, the top surface portion, and the rear surface portion of the applicator head 212 have now, in effect, become the bottom surface portion 215, the front surface portion 232, and the top surface portion 214. In either orientation, the filter assemblies 64,164,264 are always substantially vertically oriented, or at least have a substantially partial vertical orientation. In this manner, when the filter assemblies are to be replaced or exchanged and are disengaged and removed from their respective applicator heads 12,112,212, residual hot melt adhesive does not leak out from the filter cavity 60 which would in fact otherwise occur if, for example, the filter assemblies 12,112,212 were in fact disposed or oriented horizontally.

Thus, it may be seen that in accordance with the teachings and principles of the present invention, various modes or arrangements of the components of the hot melt adhesive applicator assemblies can be achieved so as to permit or facilitate accommodation, integration, incorporation, or installation of the applicator assemblies within limited or constrained spatial allowances within existing equipment, installations, production lines, or the like. In particular, the filter assembly is interposed between the alternatively disposed adhesive supply conduits such that the same or single filter assembly can be used in connection with the two adhesive supply conduits regardless of the connections of the two adhesive supply conduits to the applicator head. In addition, the applicator head per se can be angularly rotated to a new orientation, however, the replaceable filter assembly is nevertheless properly oriented in a substantially vertical mode so as to effectively prevent any leakage of adhesive material from the applicator head when replacement or exchange of the filter assembly is performed during maintenance operations.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America is:

1. A material applicator assembly, comprising:

an applicator head;

an application module mounted upon said applicator head for dispensing a material;

first connection means defined at a first location upon said applicator head for enabling connection of a material supply hose to said applicator head so as to supply material to said application module;

second connection means defined at a second location upon said applicator head, remote from said first location at which said first connection means is defined, for enabling connection of a material supply hose to said applicator head so as to supply material to said material application module; and filter means mounted upon said applicator head at a location interposed between said first and second connection means such that said filter means can provide filtered material from a material supply hose, operatively connected to either one of said first and second connection means of said applicator head at either one of said first and second locations, to said application module.

2. The assembly as set forth in claim 1, further comprising:

plug means mounted within one of said first and second connection means when said material supply hose is respectively connected to the other one of said first and second connection means.

3. The assembly as set forth in claim 1, wherein:

said applicator head comprises at least front, top, bottom, and back surface portions;

said application module is mounted upon said front surface portion of said applicator head; and said first and second connection means are provided upon said top and back surface portions of said applicator head.

4. The assembly as set forth in claim 3, wherein:

said filter means has a longitudinal axis; and said filter means is mounted upon a surface of said applicator head which is inclined at a predetermined angle with respect to a horizontal plane such that said longitudinal axis of said filter means is disposed substantially vertically.

5. The assembly as set forth in claim 3, further comprising:

means for mounting said applicator head upon support structure such that said applicator head is effectively rotated 90° from an original orientation whereby said application module is now mounted upon said bottom surface portion of said applicator head, and said first and second connection means are now provided upon said front and top surface portions of said applicator head.

6. The assembly as set forth in claim 5, wherein:

said filter means has a longitudinal axis; and said filter means is mounted upon a surface of said applicator head which is inclined at a predetermined angle with respect to a horizontal plane such that said longitudinal axis of said filter means is disposed substantially vertically.

7. The assembly as set forth in claim 1, wherein:

said applicator head comprises at least front, top, bottom, and back surface portions;

said first and second connection means are located upon said top and back surface portions of said applicator head; and means for mounting said applicator head upon support structure is provided upon one of said top and back surface portions of said applicator head when a material supply hose is connected to one of said first and second connection means located upon the other one of said top and back surface portions of said applicator head.

8. The assembly as set forth in claim 1, further comprising:

a filter cavity defined within said applicator head; and means for removably mounting said filter means within said filter cavity defined within said applicator head.

9. The assembly as set forth in claim 8, wherein:

said first and second connection means comprise material conduits which are fluidically connected to said filter cavity, whereby regardless of which one of said first and second connection means is used to connect a material supply hose to said applicator head, material from said material supply hose is able to be fluidically conducted to said filter cavity.

10. The assembly as set forth in claim 9, wherein:

said applicator head comprises at least top and back surface portions;

said material conduits of said first and second connection means have longitudinal axes; and said first and second connection means are provided upon said top and back surface portions of said applicator head such that said longitudinal axes of said material conduits of said first and second connection means are disposed substantially perpendicular to each other.

11. A hot melt adhesive applicator assembly, comprising:

an applicator head;

an application module mounted upon said applicator head for dispensing a hot melt adhesive;

first connection means defined at a first location upon said applicator head for enabling connection of an adhesive supply hose to said applicator head so as to supply an adhesive material to said application module;

second connection means defined at a second location upon said applicator head, remote from said first location at which said first connection means is defined, for enabling connection of an adhesive material supply hose to said applicator head so as to supply adhesive material to said adhesive material application module; and filter means mounted upon said applicator head at a location interposed between said first and second connection means such that said filter means can provide filtered adhesive material from an adhesive material supply hose, operatively connected to either one of said first and second connection means of said applicator head at either one of said first and second locations, to said adhesive material application module.

12. The assembly as set forth in claim 11, further comprising:

plug means mounted within one of said first and second connection means when said adhesive material supply hose is respectively connected to the other one of said first and second connection means.

13. The assembly as set forth in claim 11, wherein:

said applicator head comprises at least front, top, bottom, and back surface portions;

said application module is mounted upon said front surface portion of said applicator head; and said first and second connection means are provided upon said top and back surface portions of said applicator head.

14. The assembly as set forth in claim 13, wherein:

said filter means has a longitudinal axis; and said filter means is mounted upon a surface of said applicator head which is inclined at a predetermined angle with respect to a horizontal plane such that said longitudinal axis of said filter means is disposed substantially vertically.

15. The assembly as set forth in claim 3, further comprising:

means for mounting said applicator head upon support structure such that said applicator head is effectively rotated 90° from an original orientation whereby said application module is now mounted upon said bottom surface portion of said applicator head, and said first and second connection means are now provided upon said front and top surface portions of said applicator head.

16. The assembly as set forth in claim 15, wherein:

said filter means has a longitudinal axis; and said filter means is mounted upon a surface of said applicator head which is inclined at a predetermined angle with respect to a horizontal plane such that said longitudinal axis of said filter means is disposed substantially vertically.

17. The assembly as set forth in claim 11, wherein:

said applicator head comprises at least front, top, bottom, and back surface portions;

said first and second connection means are located upon said top and back surface portions of said applicator head; and means for mounting said applicator head upon support structure is provided upon one of said top and back surface portions of said applicator head when an adhesive material supply hose is connected to one of said first and second connection means located upon the other one of said top and back surface portions of said applicator head.

18. The assembly as set forth in claim 11, further comprising:

a filter cavity defined within said applicator head; and means for removably mounting said filter means within said filter cavity defined within said applicator head.

19. The assembly as set forth in claim 18, wherein:

said first and second connection means comprise adhesive material conduits which are fluidically connected to said filter cavity, whereby regardless of which one of said first and second connection means is used to connect an adhesive material supply hose to said applicator head, adhesive material from said adhesive material supply hose is able to be fluidically conducted to said filter cavity.

20. The assembly as set forth in claim 19, wherein:

said applicator head comprises at least top and back surface portions;

said adhesive material conduits of said first and second connection means have longitudinal axes; and said first and second connection means are provided upon said top and back surface portions of said applicator head such that said longitudinal axes of said adhesive material conduits of said first and second connection means are disposed substantially perpendicular to each other.

21. A hot melt adhesive applicator assembly, comprising:

an applicator head;

an application module mounted upon said applicator head for dispensing a hot melt adhesive;

first connection means defined at a first location upon said applicator head for enabling connection of an adhesive supply hose to said applicator head so as to supply an adhesive material to said application module;

second connection means defined at a second location upon said applicator head, remote from said first location at which said first connection means is defined, for enabling connection of an adhesive material supply hose to said applicator head so as to supply adhesive material to said adhesive material application module; and a single filter assembly mounted upon said applicator head at a single location interposed between said first and second connection means such that said single filter assembly can provide filtered adhesive material from an adhesive material supply hose, operatively connected to either one of said first and second connection means of said applicator head at either one of said first and second locations, to said adhesive material application module.

22. The assembly as set forth in claim 21, further comprising:

plug means mounted within one of said first and second connection means when said adhesive material supply hose is respectively connected to the other one of said first and second connection means.

23. The assembly as set forth in claim 21, wherein:

said applicator head comprises at least front, top, bottom, and back surface portions;

said application module is mounted upon said front surface portion of said applicator head; and said first and second connection means are provided upon said top and back surface portions of said applicator head.

24. The assembly as set forth in claim 23, wherein:

said filter assembly has a longitudinal axis; and said filter assembly is mounted upon a surface of said applicator head which is inclined at a predetermined angle with respect to a horizontal plane such that said longitudinal axis of said filter assembly is disposed substantially vertically.

25. The assembly as set forth in claim 23, further comprising:

means for mounting said applicator head upon support structure such that said applicator head is effectively rotated 90° from an original orientation whereby said application module is now mounted upon said bottom surface portion of said applicator head, and said first and second connection means are now provided upon said front and top surface portions of said applicator head.

26. The assembly as set forth in claim 25, wherein:

said filter assembly has a longitudinal axis; and said filter assembly is mounted upon a surface of said applicator head which is inclined at a predetermined angle with respect to a horizontal plane such that said longitudinal axis of said filter means is disposed substantially vertically.

27. The assembly as set forth in claim 21, wherein:

said applicator head comprises at least front, top, bottom, and back surface portions;

said first and second connection means are located upon said top and back surface portions of said applicator head; and means for mounting said applicator head upon support structure is provided upon one of said top and back surface portions of said applicator head when an adhesive material supply hose is connected to one of said first and second connection means located upon the other one of said top and back surface portions of said applicator head.

28. The assembly as set forth in claim 21, further comprising:

a filter cavity defined within said applicator head; and means for removably mounting said filter assembly within said filter cavity defined within said applicator head.

29. The assembly as set forth in claim 28, wherein:

said first and second connection means comprise adhesive material conduits which are fluidically connected to said filter cavity, whereby regardless of which one of said first and second connection means is used to connect an adhesive material supply hose to said applicator head, adhesive material from said adhesive material supply hose is able to be fluidically conducted to said filter cavity.

30. The assembly as set forth in claim 29, wherein:

said applicator head comprises at least top and back surface portions;

said adhesive material conduits of said first and second connection means have longitudinal axes; and said first and second connection means are provided upon said top and back surface portions of said applicator head such that said longitudinal axes of said adhesive material conduits of said first and second connection means are disposed substantially perpendicular to each other.

* * * * *